United States Patent [19]

Veisz et al.

[11] 4,367,449

[45] Jan. 4, 1983

[54] MAGNETOMECHANICAL CONVERTER

[76] Inventors: György Veisz, Radayu u.34.; Péter Köszegi, Damjanich u.25/a, both of, Budapest, Hungary

[21] Appl. No.: 217,255

[22] Filed: Dec. 17, 1980

[51] Int. Cl.[3] ..... H01F 7/08

[52] U.S. Cl. ..... 335/229; 335/78; 335/186; 335/182

[58] Field of Search ..... 335/78, 79, 84, 179–183, 335/229–231, 235, 236, 266, 267; 361/208, 210

[56] References Cited

U.S. PATENT DOCUMENTS

| | | | |
|---|---|---|---|
| 1,213,298 | 1/1917 | Summers | 335/231 X |
| 1,319,723 | 10/1919 | Nolte | 335/179 X |
| 2,793,265 | 5/1957 | Crissinger | 335/236 X |
| 3,277,408 | 10/1966 | Highley, Jr. | 335/84 X |

*Primary Examiner*—William M. Shoop

[57] ABSTRACT

A magnetomechanical converter for the variable adjustment of an outer circuit with great accuracy. The converter comprises an armature, a unit containing magnets for generating a magnetic field of variable intensity, and a device for varying the intensity of the generated magnetic field, wherein the armature and the generating unit are movable relatively to one another.

26 Claims, 15 Drawing Figures

MAGNETOMECHANICAL CONVERTER

BACKGROUND OF THE INVENTION

The invention relates to a magnetomechanical converter for relays, which assures the variable adjustment of an outer circuit with a great accuracy in a wide range of the domain of current intensities as well as of voltages of the current supply. The magnetomechanical converter of the invention, which operates with direct current as well as with an alternating current supply, can be used particularly for constructing power relays of high sensitivity and accuracy.

For the solution of different problems related to security, signalizing, or communication, relays are widely used in electrotechnics and in many other types of techniques. The relays are usually constructed in two basic types, as electromagnetic relays and as polarized relays. These devices represent a magnetomechanical converter for converting the energy of a magnetic field to a mechanical energy form for generating a mechanical movement. The relays comprise at least an armature and a unit for generating a magnetic field, wherein the armature and the generating unit are movable relatively to one another.

The electromagnetic relays comprise a pot magnet stator and thereabout an armature which is movably guided and may be coupled with a movement opposing spring. The armature is consisted in general of soft-iron or of other soft magnetic material. The stator forms an electromagnet whose energizing coil is wound on a column of the pot. At the moment when the current reaches a predetermined value, the magnetic field being generated by the coil causes the armature to move: this is the pick-up or the response of the relay. The movement may terminate upon the completion of a switching operation. The electromagnetic relay can be supplied by a direct current as well as by alternating current. Its response follows in a wide range of current intensities surrounding the predetermined current value. The low accuracy of the pick-up can be bettered in the electromagnetic relays of highest quality, i.e. in the protective relays, which have to be produced by a much accurate processing from carefully selected materials, and are relatively expensive.

If the protection relays, e.g. for protection against fire, for protection of property must have a great operating accuracy of the response, they are usually connected with electronic regulating systems. Such solution causes well-known disadvantages, because the electronic circuits have to work together with power circuits. The combination may be too expensive in some cases.

The main characteristics of polarized relays lies in their pick-up at the moment when a current appears in its energizing coil. Pick-up of the relay will be caused by any current, and not only by a current of predetermined value. The basic type of polarized relays contains a movable armature situated between the north and the south poles of a magnetic stator. Either the stator or the armature consists of an electromagnet and the other element is produced from a hard magnetic material. The electromagnet is energized by a direct current. A polarized relay, when supplied by an alternating current, cannot be used for protection—e.g. the electric bell represents this kind of the polarized "relays." The armature of a relay, when the relay is in a standstill position, rests at one of the poles. If a direct current flows through the relay, in the electromagnet the polarity of the poles will be interchanged with one another, and therefore the armature changes its position, moving towards the other pole. This movement may also be of a predetermined extent when the relay is used for switching operations. For regulating the current intensity for relay operation a well-known possibility lies in the use of a spring, but the accuracy of the spring-moved constructions is low. If an accurate regulation must be achieved, the parts of the relay must be processed with high precision and the materials of which they are made should be carefully delected.

A special kind of relays is known from the prior art, namely the TR/S 43 type produced by Siemens Inc., Germany. This relay, which had been widely used in telegraphy, is really composed of two polarized relays. The two electromagnets are situated so that when a current flows through them, their north and south poles lie against one another. The armature is disposed between the electromagnets, and it consists of a long flattened permanent magnet which is polarized parallel to the flat area. The plane of polarization lies parallel or approximatively parallel to a plane containing the north and the south poles of the electromagnet. In the standstill position of the relay and after its operation the armature contacts one of the poles in order to decrease the dispersion of the magnetic flux. The direct current flowing in the electromagnets causes the interchange of the polarity of their poles, and therefore the armature will move from one pole to the other. If the dispersion of the magnetic flux were not so strong, the relay would assure a very good operating characteristics, but the dispersion disturbs the operation and therefore this type of relay is nowadays practically out of the use.

The common characteristic of the above described relays lies in the use of closed magnetic circuits for decreasing the magnetic flux dispersion to a minimal level. In these relays, the work will be assured by energizing either the electromagnet of the stator or the armature, and by the interaction between the armature and the stator. For decreasing the magnetic flux dispersion, the magnetic circuits are so constructed that the magnetic field lines lie in the parts of the magnetic circuit.

A further common characteristic of the known relays and a further limit for their use follows from the unfavorable value of their resetting ratio. It is most desirable that the relay shall return to the starting position immediately when the value of the current has decreased to below the tripping value. The resetting ratio of the known relays can be maximalized at about 80%, instead of the desired 100%. This 80% maximal value can be reached only by specially constructed protection relays produced from selected materials by processing of high accuracy. The commonly used relays are characterized by a much lower value of the resetting ratio than the 80% above mentioned.

By using contactors, thyristors and other similar elements, better operating conditions can be ensured for the relays. This solution has some disadvantages because the use of circuits of different current intensities bring up a number of known problems. Further, the weak current unit has to be equipped by an effective system for protecting against disturbing influences originating in the power circuits.

SUMMARY OF THE INVENTION

The invention has among its objects the creation of a magnetomechanical converter for operating with high accuracy with a well-defined current value, ensuring a great value of the resetting ratio. Another object of the invention is to create a magnetochemical converter which produces a high torque on a shaft.

The invention is based on the discovery that contrary to the known solutions the poles of the same signs of two magnets can be used for creating a very effective, sensitive magnetomechanical converter of great accuracy. Professionally recognized theory holds that in the different devices having at least two energized magnets the poles of the same sign should not lie opposite one another, because this solution causes a great dispersion of the magnetic flux. In accordance with the present invention, however, there are used at least two magnets, the poles of the same sign of which lie opposite one another with an interspace to form respective non-closed magnetic circuits operating against one another, the armature being located in this interspace. The converter of the invention, which is completed by at least two non-closed magnetic circuits, ensures the possibility of constructing very effective switch units and relays. The armature is produced from a soft magnetic material of a high relative magnetic permeability. The movement of the armature may also be caused by regulating the intensity of the magnetic field between the opposite poles. If the armature is placed near a first one of the poles and the intensity of the magnetic field around the opposite second pole is increased, at a defined intensity value the armature will be reversely magnetized and move—under the repelling influence of the first pole and under the pull influence of the second one—very quickly to the second pole. The soft magnetic material can be magnetized at any time with a desired frequency; therefore the number of the position changes of the armature is practically limitless.

On the basis of the above, the invention also includes a magnetomechanical converter for relays having an outer circuit which can be variably adjusted with high accuracy. Such relay comprises an armature, a unit containing magnets for generating a magnetic field of variable intensity, and means for varying the intensity of the generated magnetic field, wherein the armature and the generating unit are movable relatively to one another, at least two of the magnets of the generating unit are situated for building up magnetic circuits operating against one another and being closed outside of the magnets, the armature is situated between the magnets, and is formed by a soft magnetic material of higher than 1.2 relative magnetic permeability.

The generating unit may particularly comprise as a magnet, a permanent magnet with or without an energizing coil, or a soft-iron core with an energizing coil.

In a preferred embodiment of the magnetomechanical converter of the invention, a resilient return member is coupled either with the armature or with the generating unit, and the standstill position of the resilient return member corresponds to the standstill position of the armature.

In an other preferred embodiment, at least two of the magnets of the magnetomechanical converter of the invention are situated in pairs, having at least one of the poles disposed opposite to another pole of the same polarity.

For limiting the relative movement of the armature and of the generating unit a stop dog may be provided. The stop dog, which may be constructed in the form of a pole shoe, preferably is coupled with a unit for regulating its position.

The armature can be formed e.g. from ferromagnetic or ferrimagnetic material.

In an especially preferred embodiment of the magnetomechanical converter of the invention, at least two of the magnets are situated along a circle and at least one of them is movable along such circle.

The relative movement of the armature and of the unit for generating the magnetic field can be regulated with great accuracy: the tripping current is well-defined, well-reproducible and well-regulable. When it is necessary, the resetting ratio can be selected either for a given value or particularly for a near to 100% value. With the magnetomechanical converter of the invention a relay can be built, which after reaching a predetermined value of current, operates with high accuracy, selectively, giving a high starting moment. With such high starting moment, a relay can be built which immediately operates as a mechanical switching unit. In comparison with known devices, the magnetomechanical converter of the invention is of much simpler construction, and can be produced at low cost. Such converter can be supplied by direct current as well as by alternating current of any frequency, and is not sensitive to changes of position.

BRIEF DESCRIPTION OF DRAWINGS

Further objects, features and advantages of the invention will become better understood by the following detailed description when considered in conjunction with the accompanying drawings, wherein.

DESCRIPTION OF THE PREFERRED EMBODIMENTS

Figure 1A:
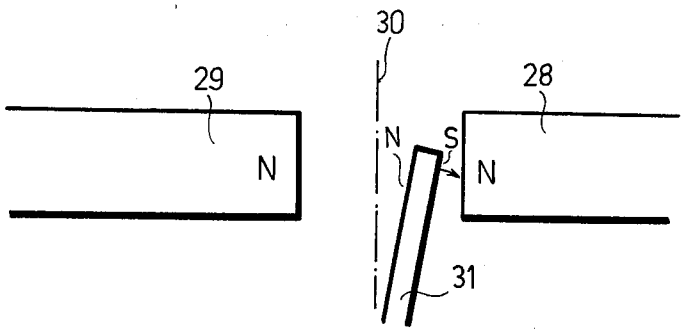
FIGS. 1*a* and 1*b* are schematic drawings showing the basic principle of the magnetomechanical converter of the invention.
Figure 1B:
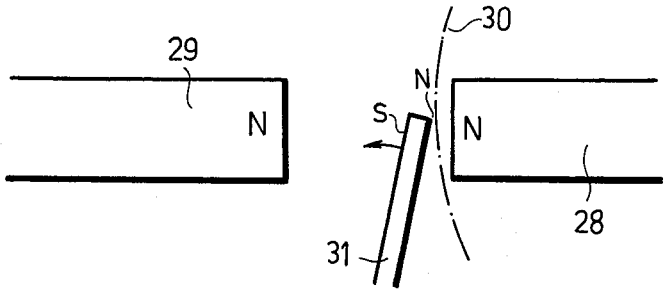

The basic principle of the magnetomechanical converter of the invention will be explained by reference to FIGS. 1*a* and 1*b*. Two poles 28, 29 of the same sign (here marked designated N) are situated oppositely to one another in a unit for generating a variable magnetic field. An armature 31 is disposed in an interspace limited by the poles 28, 29. The armature 31 lies in its initial position (FIG. 1*a*) near the pole 28. In this position of the armature of the converter the magnetic field consists of two parts around the poles 28, 29 and the parts are separated by an imaginary dead line 30. If the intensity of the magnetic field around the pole 29 increases, the dead line 30 will move continually toward the pole 28 as shown in FIG. 1*b*, defined value of the field intensity the armature 31 will be reversely magnetized by regrouping its magnetic domain structure. The remagnetized armature will then be pulled by the pole 29. The regrouping will result in an interchange of the magnetic poles of the armature 31 and consequently in generating a pull between the armature 31 and the pole 29. In this way a movement of the armature 31 relative to the poles 28, 29 can be achieved.

During the regrouping of the magnetic domain structure the dead line 30 is continually displacing in the direction of the pole 28 as explained above, and therefore the pull influence of the pole 28 decreases. At a well-defined value of the field intensity there occurs the condition in which the repelling and the pulling influences of the poles in the armature are equal. At the next moment the further change of the magnetic field intensity will cause the change of the position of the armature 31 to the pole 29 as indicated by the arrow in FIG. 1*b*. The value of the magnetic field intensity at which the armature changes its position may be defined with a high accuracy.

A preferred embodiment of the magnetomechanical converter is characterized by using a resilient return member, whose standstill condition corresponds to the standstill position of the moving element, e.g. of the armature 31. By using such a resilient return member the movement of the armature 31 will not be initially influenced. The parameters of the resilient return member should of course, be so defined, that the movement of the armature will be caused when it is needed. The manner of definition of the parameters of the resilient return member is well-known for all who skilled in the art.

For the carrying out of the described basic principle, the relative movement of the armature 31 and of the magnetic poles 28, 29 is necessary. Therefore it is possible also to fix the armature and to move the generating unit (the poles).

The different manners of operation of the work of the electromagnetic converter of the polarized relays, and of the relays equipped with a magnetomechanical converter in accordance with the invention can be analyzed on the basis of the corresponding time diagrams of FIGS. 4*a*–4*e*, inclusive.

Figure 4A:
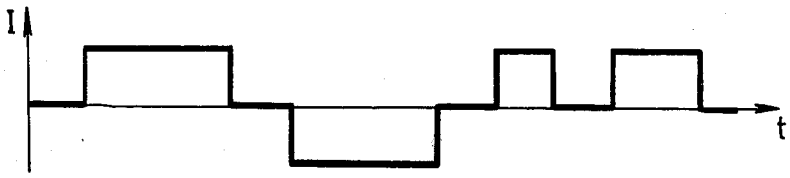
FIGS. 4*a* and 4*e* are time-diagrams of different magnetomechanical converters.
Figure 4B:
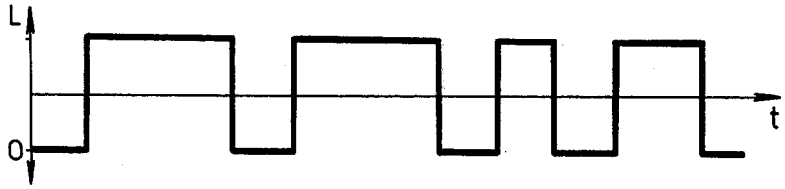
Figure 4C:
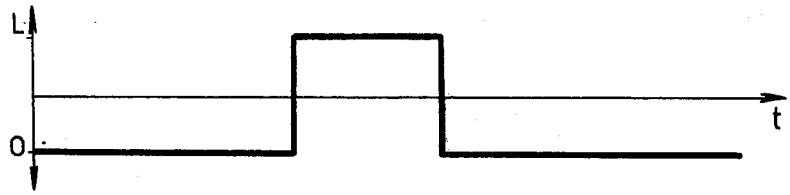

The time diagram of the magnetic field generating current is shown in FIG. 4*a*. The electromagnetic relays operate at this current according to the time diagram shown in FIG. 4*b*, and the polarized relays operate according to the time diagram shown in FIG. 4*c*. In this case the electromagnetic relay indicates the lack of current by the logical level 0, and the logical level L indicates any value which is different from zero. The polarized relay of FIG. 4*e* indicates the non-negative values of the current by the logical level L, and the negative values by the logical level 0 or conversely.

On time diagram of FIG. 4*a* it would be necessary properly to show a curve (not shown) through the corners. On the basis of such a curve the afore-analyzed disadvantages of the known relays can be still better understood.

Figure 4D:
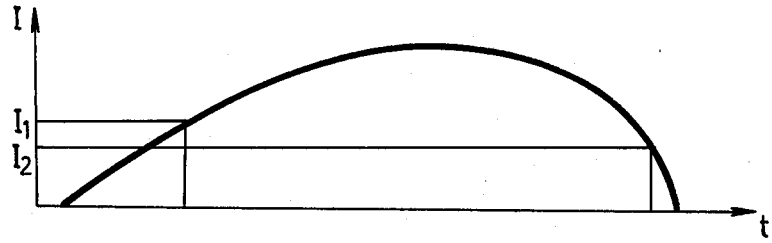
Figure 4E:
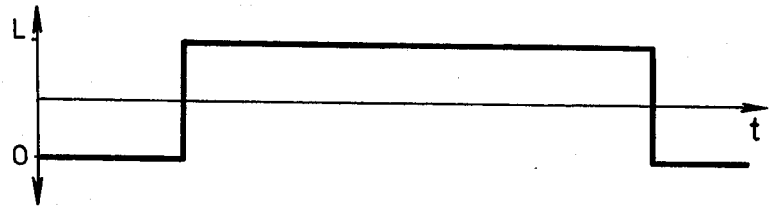

If the current value changes according to FIG. 4*d*, the magnetomechanical converter of the invention works according to FIG. 4*e*. The armature of the converter remains in one position up to the point at which the energizing current reaches the accurate value $I_1$, and the changed position remains up to the increased current value $I_2$. The values $I_1$ and $I_2$ can be regulated, for example, by regulating the position of a stop dog, or by changing the distance between the opposed poles.

FIGS. 2, 3, and 5–10, inclusive, illustrate some possibilities of employing the magnetomechanic converter of the invention. These representative preferred embodiments and refinements thereto will now be discussed for the purpose of illustration.

Figure 2:
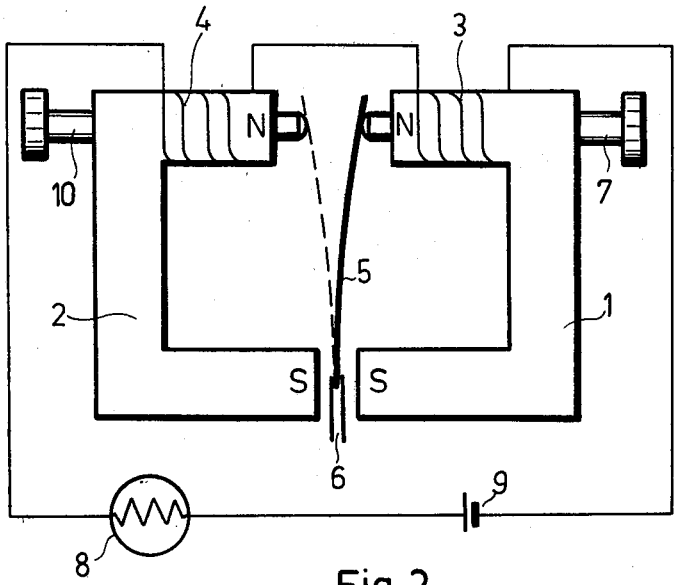
FIG. 2 illustrates schematically the relay being equipped with a first embodiment of the magnetomechanical converter of the invention and with a temperature sensing element.

For temperature regulation, on the basis of the magnetomechanical converter of the invention a relay shown in FIG. 2 has been developed. This relay comprises permanent magnets 1 and 2 which are provided with respective energizing coils 3 and 4. The permanent magnets 1 and 2 are situated opposite one another with their poles N, N and S, S confronting and spaced from each other. The energizing coils 3 and 4 are wound on corresponding soft-iron cores which form the respective pole shoes of the permanent magnets. The winding directions of the energizing coils 3 and 4 are the same; therefore a very effective method has been provided for regulating the intensity of the magnetic field: increasing the current intensity of one of the magnets and decreasing the current intensity of the second one. On this basis, a very sensible regulating system is provided.

A movable armature 5 is situated in the interspace between the poles N—N of the permanent magnets 1 and 2, armature 5 being mounted in a support 6. The armature 5, which is made of a soft magnetic material, particularly of soft iron, is flexible, and it lies in an initial position (shown by a fall line) nearer to the pole N of the permanent magnet 1. The armature 5 is then engaged by a stop dog 7, the effective length of which is adjusted by a screw. By increasing the intensity of the magnetic field around the permanent magnet 2, the magnetic domain structure of the armature 5 will be progressively reversely magnetized. At a defined value of the magnetic field intensity the armature 5 will have started to move forward the permanent magnet 2.

The energizing coils 3 and 4 are connected in series with one another and with a direct current supply source 9 as well as with a sensing element 8.

For the sensing element 8 an element can be used which is characterized by a resistance which is dependent on the temperature to be controlled. An increasing temperature results in the decreasing resistance of the element 8, and consequently in an increasing intensity of the magnetic field of the energizing coils 3 and 4. The increased magnetic field intensity of the energizing coil 3 will cause the decrease of the magnetic field intensity of the permanent magnet 1, and at the same time the magnetic field intensity of the permanent magnet 2 will be increased by the energizing coil 4. At a well-defined current value, i.e. at a well-defined temperature, the increasing magnetic field intensity around the magnet made up of the permanent magnet 2 and the energizing coil 4 causes the regrouping the magnetic domain structure of the armature 5. This regrouping provides a pull upon the armature 5 which is limited by the stop dog 10 associated with permanent magnet. Dog 10 is similar to stop dog 7. A decrease of the temperature will result in the reverse process. By changing the positions of the stop dogs 7 and 10 the work points of the relay can be regulated without any difficulties. The relay can be connected with an outer circuit (not shown) in a common manner so that the movement of the armature 5 operates a switch in such outer circuit.

Figure 3:
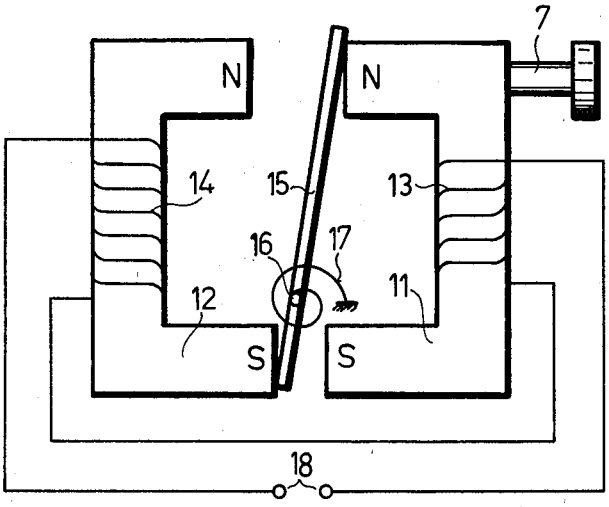
FIG. 3 shows schematically a second embodiment of the magnetomechanical converter of the invention, such converter being adopted for current limiting.

In FIG. 3 there is shown a current limiting relay which incorporates an embodiment of the magnetomechanical converter of the invention. Such relay comprises two soft-iron cores 11, 12. On the soft-iron cores 11, 12 there are wound energizing coils 13 and 14 with different numbers of turns. The energizing coils 13 and 14 are provided with terminals 18 with such polarity that the oppositely to one another situated poles have the same polarity N—N and S—S. Between the soft-iron cores 11, 12 a ferromagnetic armature 15 is situated the armature being turntable around a shaft 16 which is coupled to a coil torque spring 17. The spring 17 is advantageously so prestressed that the armature 15 is touched by but not supported by a stop dog 7 of regulable length. The energizing coils 13 and 14 are coupled in series with one another and with the circuit to be controlled through the terminals 18. By selecting a weak spring 17 the accurate regulability of the resetting ratio may be ensured and the spring force will be advantageously exploited.

In consequence of the greater number of turns of coil 14 as compared to those of coil 13, the intensity of the energizing coil 14 will increase more rapidly than the intensity of the magnetic field being generated by the energizing coil 13. At a defined value of the current intensity, the armature 15 will have started to move in the direction of the soft-iron core 14. This movement can be employed in a common way to perform mechanical or electrical functions.

Figure 6:
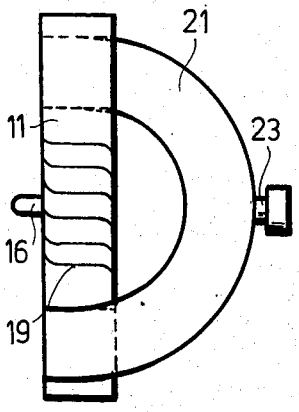
FIG. 6 is a view in cross-section of the magnetomechanical converter shown in FIG. 5, the section being taken along the line 6—6 of FIG. 5.
Figure 5:
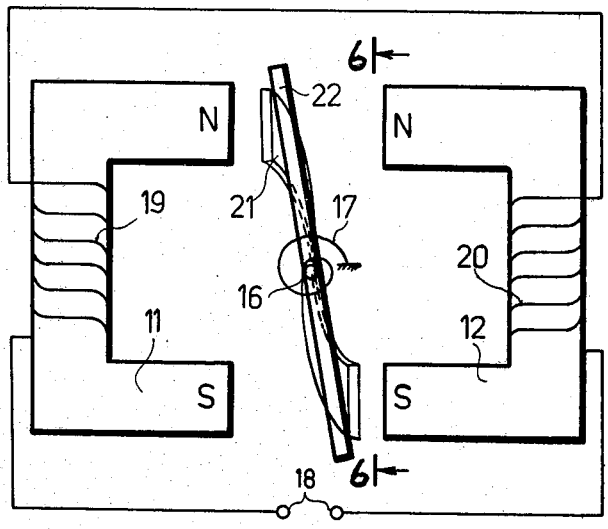
FIG. 5 shows schematically a third embodiment of magnetomechanical converter equipped with a magnetic shunt.

Turning now to FIGS. 5 and 6, there are there shown soft-iron cores 11 and 12 which are provided with energizing coils 19 and 20, respectively in a manner similar to that in FIG. 3. The energizing coils 19 and 20 have equal numbers of turns are connected in series. Between the pole N of the soft-iron core 11 and the poles S of the soft-iron core 12 there disposed an armature 22 and a magnetic shunt 21 made of magnetic material. The armature is turnable around the shaft 16 and is opposed by a torque spring 17. The magnetic shunt 21 is in the form of a half-circle annulus which is bent into a helical shape. The magnetic shunt is mounted turnably on a shaft 23 (FIG. 6) independently from the armature 22. An outer circuit can be connected in series with the energizing coils 19 and 20 through the terminals 18. In the initial position and up to a well-defined current value the magnetic shunt 21 pulls the armature 22 to itself.

At a moment of reaching the well-defined value of the generating current, the magnetic domain structure of the magnetic shunt 21 will be regrouped and the armature 22 under the repelling power of the magnetic shunt 21 will have to change its position. Regulation of the operating value of the magnetomechanic converter is possible by changing the size, configuration, and the position of the magnetic shunt 21. The magnetic shunt screens the magnetic field of the soft-iron cores 11, 12, and for ensuring different power actions between the opposing units generating magnetic fields.

Figure 7:
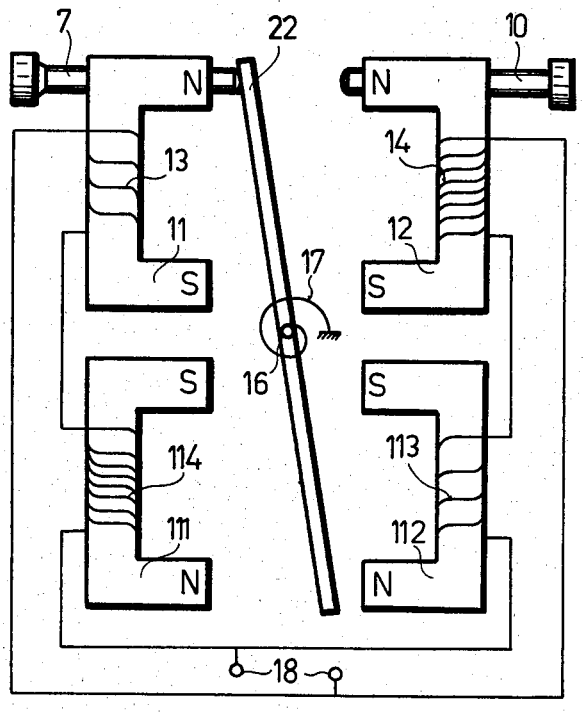
FIG. 7 shows schematically a relay being equipped with a fourth embodiment of the magnetomechanical converter of the invention, such relay being adapted for current limiting and being equipped with two symmetrical magnetic circuits.

In FIG. 7 there is shown a current limiting relay. Such relay has four soft-iron cores 11, 12, 111, 112 and four respective energizing coils 13, 14, 113, 114 with different numbers of winding turns on the soft-iron cores. Thus the coil 14 has a larger number of turns than coil 13, and the coil 114 has a larger number of turns than coil 113. The armature 22 is guided by a shaft 16 situated in the middle part of the magnetomechanical converter between the soft-iron cores 11, 12, 111, 112. The shaft 16 is opposed with a weak spring 17 in a manner similar to that described in FIG. 3. The total number of turns of the energizing coils 14 and 114 is the same as the total number of turns of the coils 13 and 113.

In its initial position, as shown, the armature 22 is urged by the spring 17 so that it touches the stop dog 7. An increase of the generating current being supplied to the terminals 18 will turn the armature 22 in a clockwise direction so as to engage the stop dog 10.

Figure 8:
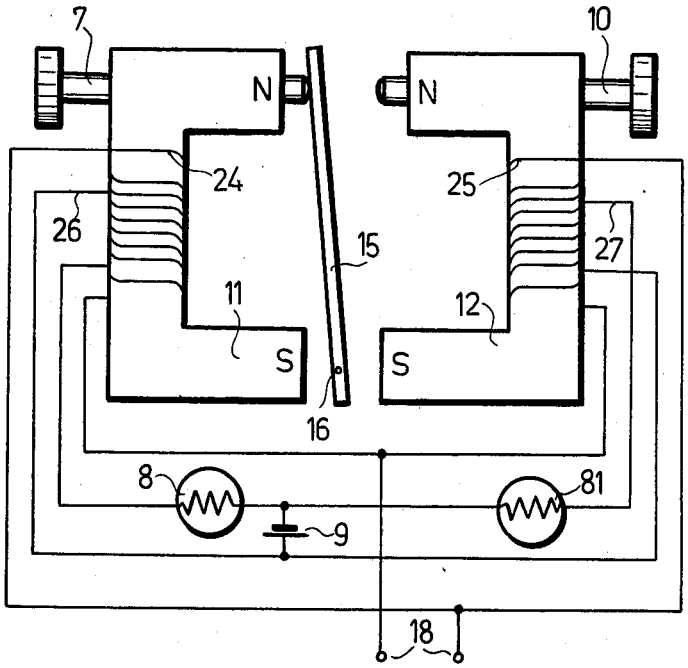
FIG. 8 shows schematically a relay being equipped with a fifth embodiment of the magnetomechanical converter of the invention, such relay being equipped with two outer sensing elements which are coupled in a differential circuit.

In FIG. 8 there is shown a relay with a differential circuit for signalizing the realization of a defined level of a parameter to be controlled, such parometer may be temperature, intensity of light, etc. The soft-iron cores 11 and 12 are provided with similar energizing coils 24 and 25 respectively, for generating a ground level of the magnetic field intensity, and are further provided with similar energizing coils 26 and 27, respectively, for generating a working level of the magnetic field intensity. The energizing coils 26 and 27 are connected in series with one another and with sensing elements 8 and 81, and are connected with a supply source 9 through sensing elements 8 and 81. The armature 15 can move between the stops 7 and 10 under the influence of the current flowing in the energizing coils 26 and 27.

Figure 9:
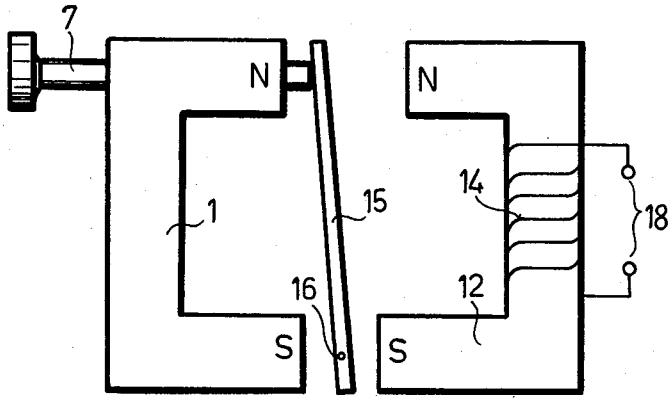
FIG. 9 shows schematically a sixth embodiment of the magnetomechanical converter of the invention equipped with a permanent magnet and with a soft-iron core having an energizing coil.

In FIG. 9 there is shown a relay for sensing a voltage level. Such relay is provided with a magnetomechanical converter comprising a permanent magnet 1 and a soft-iron core 12 having an energizing coil 14. The current of the energizing coil 14 has an intensity which is proportional to the voltage to be controlled; at a well-defined value of the voltage the position of the armature 15 is changed. In its initial position shown in FIG. 9, the armature 15 is supported by a stop dog 7 and is turnable around a shaft 16.

Figure 10:
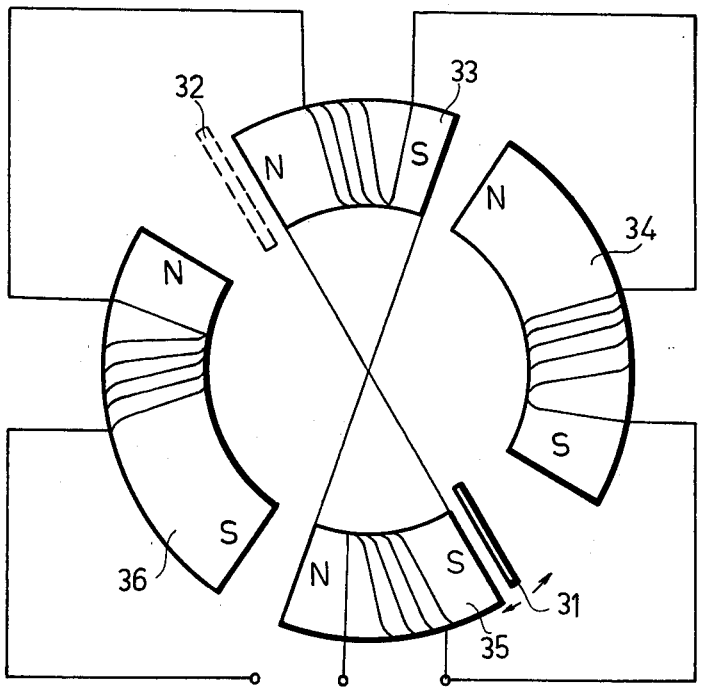
FIG. 10 shows schematically a seventh embodiment of magnetomechanical converter having magnets situated along a circle.

In FIG. 10 there is shown a relay adapted for use in mechanical switching, such relay generating a large torque. This relay contains movable and fixed magnets situated along a circle. The movable magnets 33, 35 can be coupled with a central shaft (not shown). Between the movable magnets 33, 35 and corresponding fixed magnets 34, 36 there is disposed armature 31, 32 may be of regulable position. The regrouping of the magnetic domain structure of the armature 31, 32 results in a movement of the movable magnets 33, 35 in the direction of the armature, and this movement produces a large torque on the shaft to which the armature is coupled or along the circle.

The main advantages of the converter of the invention can be recapitulated as follows:

At a well-defined value of the energizing current the parts of the converter will change their relative positions. This value can be regulated for the value of the tripping or activating current as well as for the returning of the parts to their initial positions. The relative movement is realized with a great sensitivity at the moment of reaching the predetermined value of the current, and the possibility is assured of having a large torque on the shaft. This moment can be employed to perform a mechanical function, as well as to actuate a switch to make a sure electrical contact.

The magnetomechanical converter of the invention renders the construction of simple and cheap relays possible. Relays of great reliability can be produced by the use of simple, traditional technological equipment.

The magnetomechanical converter of the invention can work in a very wide domain of ampere-voltage parameters which includes the values from mA, mV, up to kA, kV. The converter can be supplied by alternating current of any frequency, as well as by direct current, and it can be used in any orientation in space without disturbing its function.

The relay containing the magnetomechanical converter of the invention can be used in all kinds of practical applications wherein relays having special regulating units or special circuits were ordinarily used.

For example, the following applications may be mentioned:

- as primary relays in electrical power networks, in which the protection should be realized with a great accuracy;
- as limit detectors in security technical units in which an accurate and reliable detection of reaching a given limit is desired (in mining works, in the fabrication of plastics, in the chemical industry, in closed technological spaces etc.);
- in protection units;
- in signal units for detecting a given number of r.p.m.;
- as a fuse with relays of high connecting speed and accuracy;
- at millworks for signalizing non-allowed changes of the thickness of rolled sheet iron;
- in the railway field for example, for block-systems;
- in self-acting fire-extinguishers;
- in photometry;
- for selecting balls in the ball bearing industry;
- in protection systems for cranes;
- in the control units of lift systems etc.

On the basis of the description given above it can be easily seen that, within the scope of the invention and the protection claimed in the attached claims, depending on the field of application and the given circumstances, a plurality of further embodiments can be developed.

Although the invention is illustrated and described with reference to a plurality of preferred embodiments thereof, it is to be expressly understood that it is in no way limited to the disclosure of such preferred embodiments, but is capable of numerous modifications within the scope for the appended claims.

We claim:

1. A magnetomechanical converter, comprising an armature, a unit containing a plurality of magnets for generating a magnetic field, means for varying the intensity of the generated magnetic field, said armature and said generating unit being movable relatively to one another, at least two of said magnets of said generating unit being situated for building up magnetic circuits operating against one another and being closed outside of said magnets, said armature being situated between said magnets, and being formed of a soft magnetic material of higher than 1.2 relative magnetic permeability whereby variably to adjust an outer circuit with high accuracy, said armature being coupled to a magnetic shunt.

2. A magnetomechanical converter as claimed in claim 1, wherein said magnetic shunt is rotatable around a shaft and is independent of said armature.

3. A magnetomechanical converter, comprising an armature, a unit containing a plurality of magnets for generating a magnetic field, and means for varying the intensity of the generated magnetic field, said armature and said generating unit being movable relative to one another, at least two of said magnets being situated along a circle and at least one of the magnets being movable on said circle, at least two of said magnets being situated in respective magnetic circuits operating against one another and being closed outside of said magnets, said armature being situated between said magnets and formed of a soft magnetic material of higher than 1.2 relative magnetic permeability, whereby variably to adjust an outer circuit with great accuracy, and wherein two magnets are movable and two magnets are fixed, and at least one armature is situated in the interspaces between said magnets.

4. A magnetomechanical converter as claimed in claim 3, wherein said armature is coupled with a unit for regulating its position.

5. Method of converting magnetic energy into mechanical energy, comprising the steps of disposing a first magnetic pole of a first magnet against a like second magnetic pole of a second magnet in a given spaced relation, at least one of the magnets having means to adjust the intensity of its magnetic field, disposing an armature between said first and second poles adjacent to the first one, the armature being movable relatively to said magnets and formed at least partly of a soft magnetic material and in this part having a cross-section sufficient to have a definitive magnetic domain structure generated by the magnetic field of said first magnet, increasing the intensity of the magnetic field of said second magnet in comparison to the first one, and changing in this way the magnetic dispersion between said like poles at said armature so far as to alternate the magnetic domain structure of the armature and in this way to cause the relative movement of the armature and of the magnets.

6. A magnetomechanical converter, comprising an armature, a unit containing an even number of magnets for generating a magnetic field and means attached to at least one of said magnets for varying the intensity of the generated magnetic field, said armature and said generating unit being movable relatively to one another, at least two of said magnets of said generating unit being situated for building up magnetic circuits operating against one another which are closed outside of said magnets, said armature being situated between said magnets and being formed of a soft magnetic material of higher than 1.2 relative magnetic permeability, whereby variably to adjust an outer circuit with high accuracy.

7. A magnetomechanical converter, comprising an armature, a unit containing an even number of magnets for generating a magnetic field, and means for varying the intensity of the generated magnetic field, and attached to at least one of said magnets, said armature and said generating unit being movable relative to one another, at least two of said magnets being situated along a circle and at least one of the magnets being movable on said circle, at least two of said magnets being situated in respective magnetic circuits operating against one another which closed outside of said magnets, said armature being situated between said magnets and formed of a soft magnetic material of higher than 1.2 relative magnetic permeability, whereby to transfer a high switch moment.

8. A magnetomechanical converter as claimed in claim 6, wherein said generating unit comprises a permanent magnet.

9. A magnetomechanical converter as claimed in claim 6, wherein said generating unit comprises a soft-iron core provided with an energizing coil.

10. A magnetomechanical converter as claimed in claim 6, wherein said generating unit comprises a permanent magnet provided with an energizing coil.

11. A magnetomechanical converter as claimed in claim 6, comprising a resilient return member coupled to one of said armature and said generating unit, the return member having a standstill position responding to the standstill position of the coupled element.

12. A magnetomechanical converter as claimed in claim 6, wherein at least two magnets are situated in pairs and have at least one of the poles of the same magnetic polarity disposed opposite one another.

13. A magnetomechanical converter as claimed in claim 6, comprising a stop dog for limiting the relative movement of said armature and said generating unit.

14. A magnetomechanical converter as claimed in claim 13, wherein said stop dog is made in the form of a pole shoe.

15. A magnetomechanical converter as claimed in claim 14, wherein said stop dog is coupled with a unit for regulating its position.

16. A magnetomechanical converter as claimed in claim 6, wherein said armature is formed by ferro-magnetic material.

17. A magnetomechanical converter as claimed in claim 6, wherein said generating unit contains an even number of magnets disposed in pairs and having the poles of the same polarity disposed opposite to one another.

18. A magnetomechanical converter as claimed in claim 6, wherein said generating unit contains and even number of soft-iron cores provided on parts thereof by respective coils.

19. A magnetomechanical converter as claimed in claim 6, wherein said soft-iron cores are equiped in pairs by respective energizing coils of different induction power.

20. A magnetomechanical converter as claimed in claim 6, wherein said armature is flexible.

21. A magnetomechanical converter as claimed in claim 6, wherein said armature is rotatable and mounted on a shaft.

22. A magnetomechanical converter as claimed in claim 21, wherein said shaft is coupled to a torque spring.

23. A magnetomechanical converter, comprising an armature coupled to a magnetic shunt, a unit containing an even number of magnets for generating a magnetic field and means for varying the intensity of the generated magnetic field and attached to at least one of said magnets, said armature and said generating unit being movable relatively to one another, at least two of said magnets of said generating unit being situated for building up magnetic circuits operating against one another which are closed outside of said magnets, said armature being situated between said magnets, and being formed of a soft magnetic material of higher than 1.2 relative magnetic permeability, whereby variably to adjust an outer circuit with high accuracy.

24. A magnetomechanical converter as claimed in claim 23, wherein said magnetic shunt is rotatable around a shaft and is independent of said armature.

25. A magnetomechanical converter comprising a unit containing two movable magnets and two fixed magnets situated along a circle for generating a magnetic field, at least one armature situated in the interspaces between said magnets, means for varying the intensity of the generated magnetic field and attached to at least one of said magnets, said generating unit being movable relative to one another, at least two of said magnets being situated in respective magnetic circuits operating against one another which are closed outside of said magnets, said armature being situated between said magnets and formed of a soft magnetic material of higher than 1.2 relative magnetic permeability, whereby to transfer a high switch moment.

26. A magnetomechanical converter as claimed in claim 25, wherein said armature is coupled with a unit for regulating its position.

* * * * *